US005816177A

United States Patent [19]

Brocklehurst

[11] Patent Number: 5,816,177

[45] Date of Patent: Oct. 6, 1998

[54] MATERIAL FEEDING, ALIGNING CUTTING AND EDGE FINISHING SYSTEM

[75] Inventor: Charles E. Brocklehurst, Fountain Inn, S.C.

[73] Assignee: Sew Simple Systems, Inc., Fountain Inn, S.C.

[21] Appl. No.: 669,216

[22] Filed: Jun. 24, 1996

Related U.S. Application Data

[60] Provisional application No. 60/007,908, Dec. 4, 1995.

[51] Int. Cl.[6] ..... D05B 21/00; D05B 27/00; D06H 7/02; B26D 5/42

[52] U.S. Cl. ..... 112/470.05; 112/130; 112/470.07; 112/475.03; 112/475.07; 83/56

[58] Field of Search ..... 112/470.05, 470.06, 112/470.07, 470.31, 470.33, 305, 306, 307, 311, 130, 475.02, 475.03, 475.07; 83/18, 56, 61, 63, 175

[56] References Cited

U.S. PATENT DOCUMENTS

| | | | |
|---|---|---|---|
| 3,160,080 | 12/1964 | Frydryk | 93/44 |
| 3,906,878 | 9/1975 | Burton | 112/423 |
| 4,375,175 | 3/1983 | Elsas et al. | 83/18 |
| 4,437,369 | 3/1984 | Brocklehurst et al. | 83/18 |
| 4,607,582 | 8/1986 | Brocklehurst | 112/470.06 |
| 4,613,123 | 9/1986 | Franke, Sr. | 271/18.3 |
| 4,648,336 | 3/1987 | Ragnegring | 112/147 |
| 4,685,408 | 8/1987 | Frye | 112/475.06 |
| 4,688,781 | 8/1987 | Blessing | 271/1 |
| 4,742,788 | 5/1988 | Dugan | 112/475.08 |
| 4,748,922 | 6/1988 | Bierbaum et al. | 112/470.32 |
| 4,754,717 | 7/1988 | Henze et al. | 112/10 |
| 4,773,341 | 9/1988 | Brocklehurst | 112/470.16 |
| 4,856,442 | 8/1989 | Brocklehurst | 112/147 |
| 4,856,444 | 8/1989 | Brocklehurst | 112/475.06 |
| 5,018,462 | 5/1991 | Brocklehurst | 112/470.07 |
| 5,216,969 | 6/1993 | Thomas et al. | 112/7 |

FOREIGN PATENT DOCUMENTS 2133052 7/1984 United Kingdom .

*Primary Examiner*—Peter Nerbun
*Attorney, Agent, or Firm*—Thomas, Kayden, Horstemeyer & Risley

[57] ABSTRACT

A sheet material advancing and cutting apparatus for incrementally advancing the cut end of a supply of terry cloth sheet material (11) past a cutting blade (66), drawing out the supply of material to its cutting position, and cutting the material along laterally extending napless bands (26) in the material. The apparatus includes a sheet material advancing mechanism (13) for engaging the sheet material and pushing the cut end of the material across the cutting station (14). A material draw out assembly (16) includes a draw out bar (81) which moves downwardly into engagement with the leading edge of the material and pulls the material into its cutting position. The draw out bar (81) is pivoted by cylinder (111) if necessary to stretch the side of the material that is behind in its movement toward the cutting station, causing the following napless band to be straightened.

23 Claims, 6 Drawing Sheets

MATERIAL FEEDING, ALIGNING CUTTING AND EDGE FINISHING SYSTEM

CROSS REFERENCE TO PROVISIONAL APPLICATION

The application claims priority to U.S. Provisional Application Ser. No. 60/007,908, filed Dec. 4, 1995.

FIELD OF THE INVENTION

This invention pertains to a method and apparatus for forming wash cloths or other segments of sheet material from a continuous length of terry cloth, etc. having napless bands extending across the material at intervals along the material. More particularly, the invention relates to incrementally feeding sheet material, such as terry cloth toweling, from a supply roll to a cutting station where a cutting blade cuts the cloth material at the napless bands into segments, and the cut segments are advanced to an edge hemming station and the edges are finished. The terry cloth material is advanced in a controlled manner past the cutting blade so that the napless bands extending across the terry cloth material are moved into position to be cut by the cutting blade along a napless band.

BACKGROUND OF THE INVENTION

In the manufacture of terry cloth wash cloths and towels and other similar flat goods, the terry cloth material usually is accumulated in an elongated length of cloth material and wound into a supply roll. The individual wash cloths and towels are subsequently cut from the roll of supply material as the material is drawn out from the supply roll and advanced along its length through a cutting station. The cuts usually are made along the napless bands which are formed in the material to separate adjacent bath cloths, etc. The cuts across the material can be made by hand held cutters or by automated cutting equipment.

Prior art machines for controllably drawing out a precise length of material past the cutting blade employ various methods. For example, U.S. Pat. No. 4,375,175 discloses a towel cutting machine that uses a pair of feed rollers that push the cloth material along a horizontal work surface past the cutting blade. If the napless bands of the material are not oriented at a right angle with respect to the length of the work product, however, the cutting blade must be shifted to an angle to be aligned with the napless band before the cut is made.

U.S. Pat. No. 4,437,369 discloses a towel cutting machine that also employs a pair of feed rollers that, along with gravity, feed the cloth material downwardly into position to be cut by a cutting blade. The material is stretched laterally to straighten the napless bands before the bands are cut.

U.S. Pat. No. 4,607,582 discloses a towel cutting and hemming apparatus that as a plurality of fingers that engage the napless band and retard the advancement of the oncoming edge of the tufted portion of the material, thus tending to straighten the napless band.

While these prior art machines may work satisfactorily for many types of materials, they are large and somewhat complicated apparatuses that are not well suited for handling small terry cloth items such as wash cloths and hand towels. Further, the prior art systems do not include a simple and effective system for expediently straightening the terry cloth work product when the napless band to be cut is not oriented at a right angle with respect to the length of the work product before the product is cut. Hence, a need exists in the manufacture of terry cloth wash cloths and small towels, etc. as well as in the manufacture of other types of flat goods, for an improved method and apparatus for controllably advancing the terry cloth material into position to be cut by a cutting blade, straightening the material, if necessary, cutting through the material at a transverse band of the material, and hemming the cut segments of the material.

SUMMARY OF THE INVENTION

Briefly described, the present invention, in a preferred embodiment thereof, comprises a material advancing, drawing out, straightening and cutting method and apparatus for incrementally pushing the previously cut leading edge of the supply of material past a cutting station, drawing out the cut end portion of the supply of material further across the cutting station, straightening the material at the cutting station, if necessary, cutting the sheet material parallel to laterally extending napless bands in the material and then finishing the edges of the cut segment of material.

The apparatus includes a sheet material advancing mechanism for engaging the supply of sheet material and pushing the leading edge of the previously cut material across a work surface along a processing path past the cutting station, a material draw out assembly for further advancing and straightening the leading edge of the supply of material as it moves to its cutting position, and a cutter for cutting through the material.

The sheet material advancing mechanism includes a movable table having a smooth upper surface on which the leading end of the sheet material is received. An indexing cylinder is mounted to the underside surface of the table. When the indexing cylinder is activated, it reciprocates the table back and forth along the processing path. The movable table moves along the processing path in a reciprocable motion to move the sheet material forwardly along the processing path past the cutting blade. A clamp bar is attached to and moves with the movable table for alternately grasping and pushing the material, and releasing and retracting for its next cycle of operation. The clamp bar is movable downwardly and upwardly into and out of engagement with a portion of the sheet material to clamp the sheet material to the movable table as the table moves forwardly.

A pair of band sensors are positioned along each side of the movable table upstream from the cutting blade. The band sensors detect the longitudinal positions of the ends of the laterally extending napless bands in the sheet material. The laterally extending napless bands are areas of untufted material that are spaced incrementally along the length of the sheet material and the supply of sheet material is cut at the bands. The band sensors generally are proximity type sensors, each having a pivoting arm or switch that rides along the tufted sheet material. As the pivoting arms encounter the napless bands, they are pivoted downwardly, dropping into the napless bands, to indicate a napless band is passing thereunder. The band sensors detect whether the laterally extending napless band is approaching the cutting station at an angle relative to the cutting blade based upon the timing of the engagement of each sensor by the napless band. In response, the band sensors send a signal to the draw out assembly to cause the sheet material to be stretched along the side that is lagging behind and along which the napless band was detected last so as to realign the napless band at a right angle to the processing path of the sheet material. The napless band thus is aligned with the cutter to ensure that the cutter will cut through the center of the napless band.

A material draw out assembly is mounted downstream from the cutting station, positioned to engage the sheet material. The draw out assembly initially is positioned in a raised, nonengaging position adjacent the cutter and is movable in a reciprocating motion along the processing path to move the sheet material along the processing path to draw out sufficient sheet material for each segment. The draw out assembly includes a draw out bar that is movable vertically toward and away from engagement with the sheet material on the finishing table and includes a series of feet that engage and hold the sheet material against the work surface of a finishing table as the draw out assembly is moved forwardly over the work surface.

The draw out assembly includes a pivot arm supporting the draw out bar. The pivot arm is pivotally connected at one of its ends to a support plate of the draw out assembly. An adjustment cylinder is mounted between the support plate and the other end of the pivot arm, extending in a direction normal to the pivot arm. The adjustment cylinder is activated to push or pull the second end of the pivot arm across the processing path in response to the detection of the napless bands by the band sensors, thus pivoting the draw out bar, therefore tending to twist the material engaged by the draw out bar.

Upon detection of the laterally extending napless bands approaching the cutter at an angle by the sensors, the adjustment cylinder of the pivot arm is activated to pull or push the second end of the pivot arm across the processing path so as to reposition the draw out bar angularly. As a result, the sheet material is stretched along one of its sides to adjust and align the napless band with the cutter so that the cutter cuts parallel to and preferably along the center of the napless bands. This oscillating motion causes the draw out bar to be pivoted about its center to adjust the position of the sheet material engaged by the draw out bar as necessary to align the napless band of the material with the guillotine cutter.

The work surface of the apparatus is provided with an opening below the cutting blade. The opening allows the cutting blade to move downwardly through the plane of the work surface to cut through the sheet material. During a material advancing operation, the movable table is moved forwardly so as to close the opening in the work surface to move the previously cut edge of the sheet material across the opening to a position to be engaged by the material draw out assembly. Thereafter, the draw out assembly is able to reach and engage and pull the sheet material forwardly until a napless band of the sheet material is aligned with the cutter, with the draw out assembly being pivoted as necessary to align the napless band with the cutter. At the same time, the clamp bar of the movable table disengages from the sheet material, and the clamp bar and movable table then are moved rearwardly to their initial positions where the clamp bar reengages the sheet material. The cutting blade thereafter is moved through the napless band of the sheet material to separate a segment from the supply of sheet material.

With the apparatus of the present invention, the cloth material is pulled or drawn in a controlled manner past the cutting blade with the movable table and draw out assembly uniformly advancing the sheet material into position to be cut. Thus, advancement of the sheet material is carefully controlled to ensure that the sheet material moves to the cutter in a uniform and controlled manner.

After the towel segment is cut from the supply of sheet material, a transport plate moves downwardly to engage the cut towel segment and moves it over the work surface of the finishing table to the sewing head of the edge hemming station. An edge hemming station is disclosed in greater detail in U.S. Pat. No. 5,018,462. Other edge hemming systems also can be used. The sewing head then stitches an over edge hem or other border about the towel segment to create a finished product.

Accordingly, it is an object of the present invention to provide an improved and simplified method and apparatus for controllably maneuvering sheet material, such as terry cloth or other fabric, incrementally along a work surface as the material is cut into segments.

Another object of the present invention is to provide a method and apparatus for accurately aligning the laterally extending bands of the material with a cutting blade so that a proper cut is made in the material with respect to the laterally extending bands.

Another object of the invention is to provide a method and apparatus for accurately and expediently forming a hem or other border about terry cloth wash cloths and towels.

These and other objects, features, and advantages of the present invention will become apparent from the following specification, when read in conjunction with the accompanying drawings.

DETAILED DESCRIPTION

Figure 1:
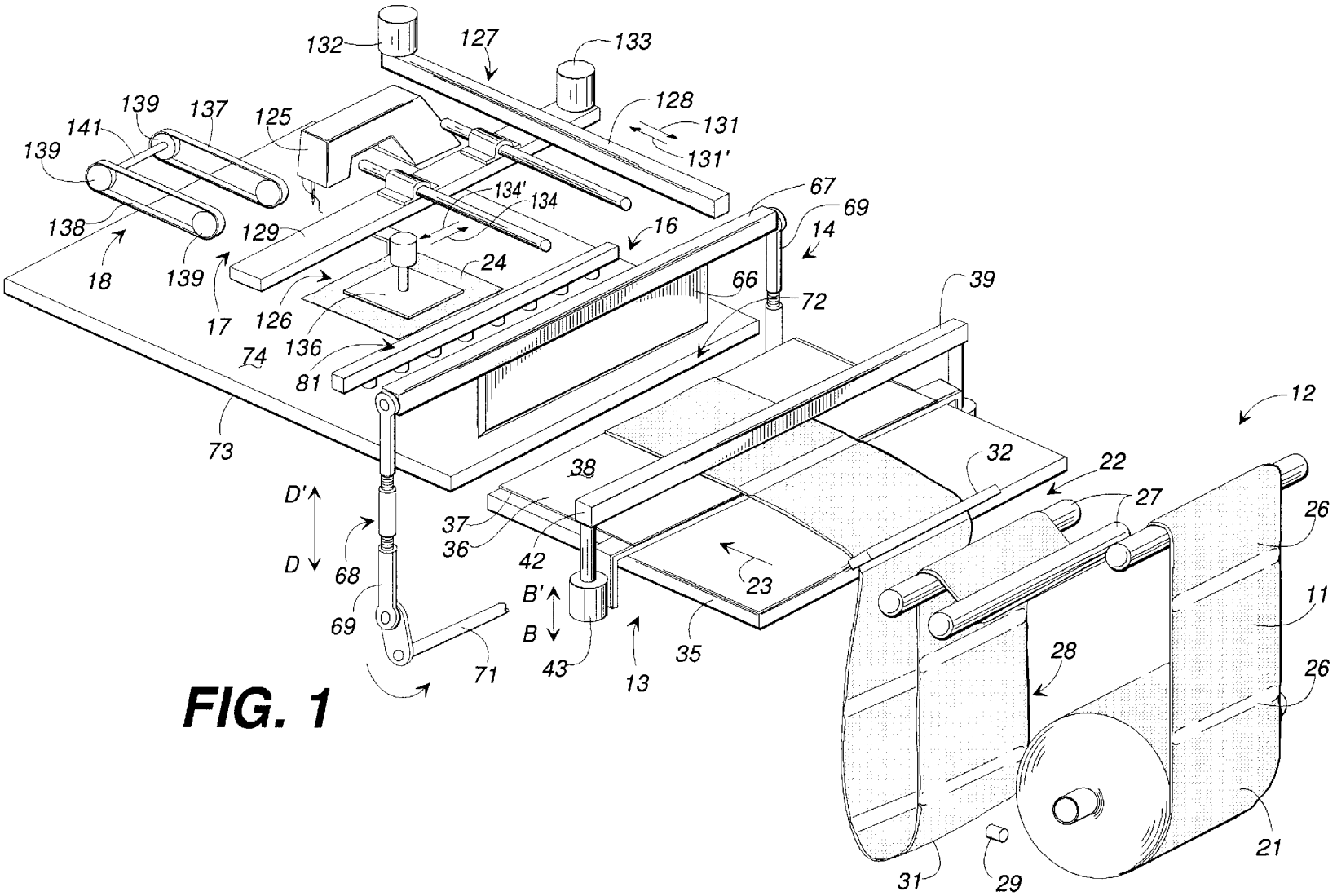
FIG. 1 is a perspective view of the material feeding, aligning, cutting and edge finishing apparatus of the present invention.

Referring now in greater detail to the drawings, in which like numerals indicate like parts throughout the several views, FIG. 1 illustrates the material feeding, aligning, cutting and edge finishing apparatus 10 for cutting and finishing the sheet material 11 to form a finished work product such as towels, washcloths, etc. The material feeding, aligning, cutting and edge finishing apparatus 10 includes a sheet material feed system 12, an advancing mechanism 13, a cutting station 14, a material draw out assembly 16, an edge hemming station 17, and a discharge assembly 18.

As FIG. 1 illustrates, the sheet material feed system 12 includes a supply roll 21 of the sheet material 11, which is mounted at a first or inlet end 22 of the material feeding, aligning, and finishing apparatus 10. Typically, the sheet material 11 comprises a tufted material such as a terry cloth towel material or the like that is fed along a processing path indicated by arrows 23 along which the sheet material 11 is cut into segments or work products 24, the edges of which are cut and hemmed in the edge hemming station 17 to form a finished product such as a washcloth, towel, etc. The sheet material further includes laterally extending bands 26 of napless, untufted material, which bands mark the divisions along which the sheet material is cut to form the segments 24. The napless bands 26 are formed at spaced intervals along the length of the sheet material 11 and become the borders at the front and rear edges of the segments cut from the sheet material. It further will be understood that while the present invention is disclosed for use in feeding, aligning, cutting and finishing segments of a tufted material such as terry cloth towels, etc., the present invention also can be adapted to advance, cut and finish other types of flat materials such as other types of fabrics, paper materials, plastics, etc.

A series of feed rollers 27 are mounted to a support frame (not shown) for the apparatus 10, positioned downstream from the supply roll 21. The sheet material 11 is fed between and engaged by the feed rollers, which pull the sheet material from the supply roll into a gravity loop 28 that hangs down between the supply roll 21 and the advancing mechanism 13 of the material feeding, aligning, cutting and finishing apparatus 10, as shown in FIG. 1. A sensor 29, such as a photocell or similar detector is positioned adjacent the lower or bottom portion 31 of the gravity loop 28 of the sheet material and senses the depth of the sheet material in its gravity loop. As the sheet material is advanced through the apparatus, the sensor detects the material being taken up from the gravity loop and signals the rotation of the feed rollers 27 to pull additional material from the supply roll 21 to maintain the gravity loop at its proper depth. Additionally, as shown in FIG. 1, a brush 32 is positioned adjacent the point where the sheet material is fed onto the advancing mechanism 13 of the apparatus 10. The brush is mounted at a slight angle above the sheet material and engages the sheet material so as to exert a drag on the sheet material as the sheet material is pulled thereunder by the advancing mechanism. The brush thus functions to place and maintain tension on the sheet material as it is advanced along its processing path 23.

As illustrated in FIGS. 1–5, the sheet material 11 is first received on the advancing mechanism 13 at the start of a feeding, aligning, cutting and finishing operation. The advancing mechanism 13 includes a stationary shelf 35 and a movable table 36 mounted adjacent the shelf. The movable table generally comprises a substantially rectangular shaped plate having a lower surface 37 and a smooth upper surface 38 typically formed from polished steel or similar metal material over which the sheet material can slide without being caught or picked. The movable table 36 is movable in the direction of arrows A and A' (FIG. 1) between an initial position shown in FIGS. 1, 2, 4 and 5 and an indexed, advanced position shown in FIG. 3 for advancing the sheet material through the cutting station 14 and along its processing path 23.

A retractable clamp bar 39 is mounted to and is movable with the movable table, as illustrated in FIG. 1. The clamp bar generally is a substantially rectangularly shaped beam that extends laterally across the upper surface 38 of the movable table 36, with the ends 41 and 42 (FIG. 1) of the clamp bar 39 slightly overlapping the side edges of the movable table. Pneumatic cylinders 43 are mounted on opposite sides of the movable table, oriented vertically. Each of these cylinders includes a piston rod 44 attached to one end 41 or 42 of the clamp bar 39. The cylinders 43 retract and extend their piston rods 44 in the direction of arrows B and B' in order to move the clamp bar from a raised, unclamping position shown in FIGS. 1 and 4 to a lowered, clamping position shown in FIGS. 2, 3 and 5.

In its clamping position, the clamp bar engages and holds the sheet material against the upper surface 38 of the movable table 36. Thus, as the movable table is moved in the direction of arrow A, the clamping of the sheet material between the clamping bar and the upper surface of the movable table causes the sheet material likewise to be moved in the direction of arrow A along its processing path 23 as indicated in FIGS. 2 and 3.

Figure 2:
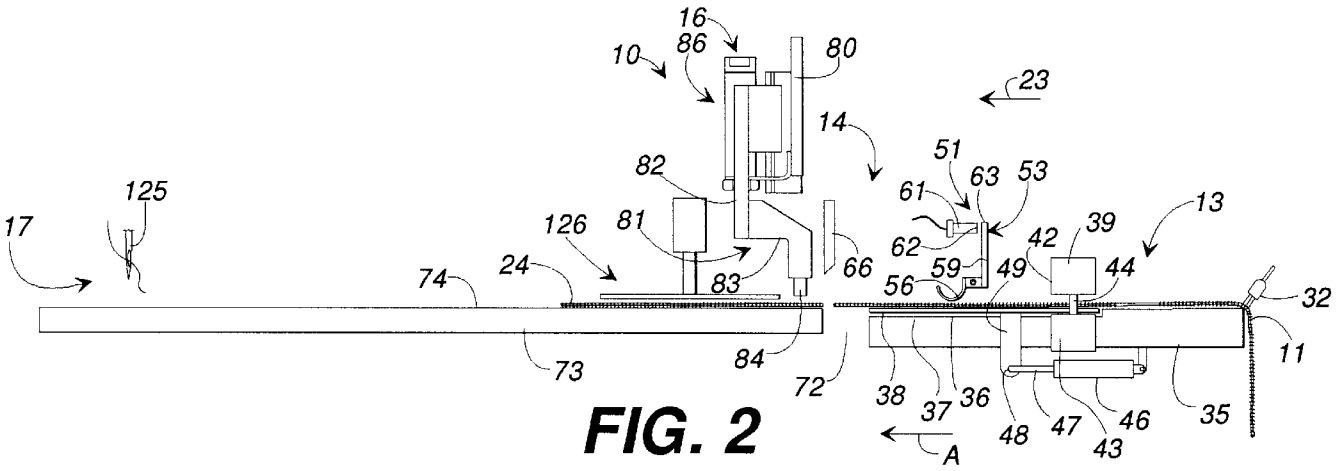
FIG. 2 is a side elevational view of the material feeding, aligning, cutting and edge finishing apparatus, schematically illustrating the advancing mechanism, cutting blade and draw out assembly in their initial, nonoperative positions.
Figure 3:
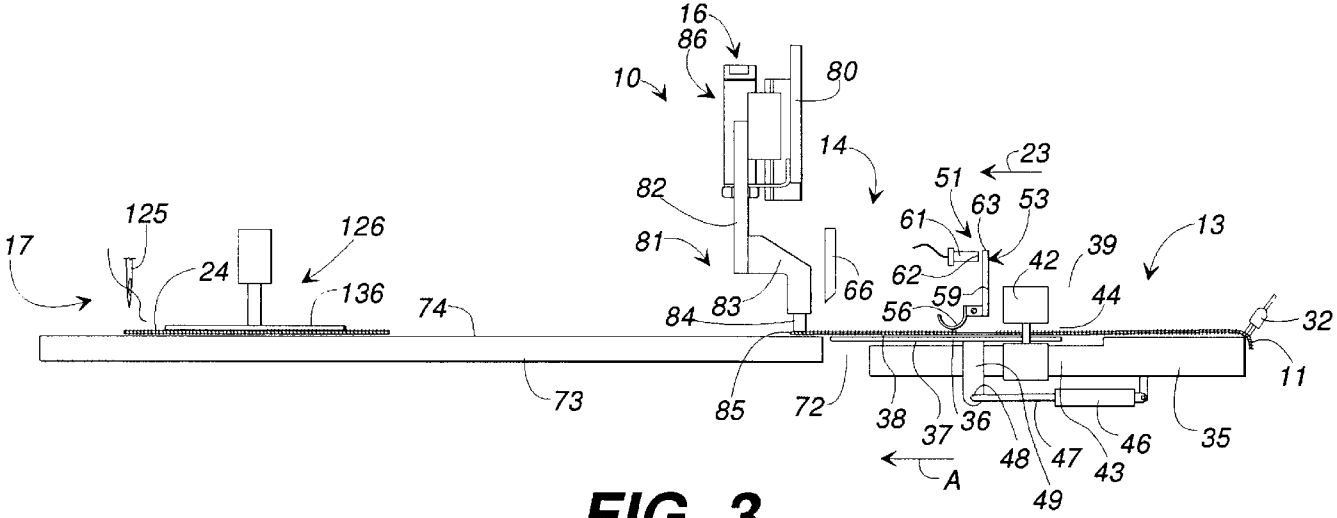
FIG. 3 is a side elevational view of the material feeding, aligning, cutting and edge finishing apparatus, similar to FIG. 2, but schematically illustrating the advancing of the sheet material through the cutting station to the draw out assembly and the lowering of the draw out assembly.
Figure 4:
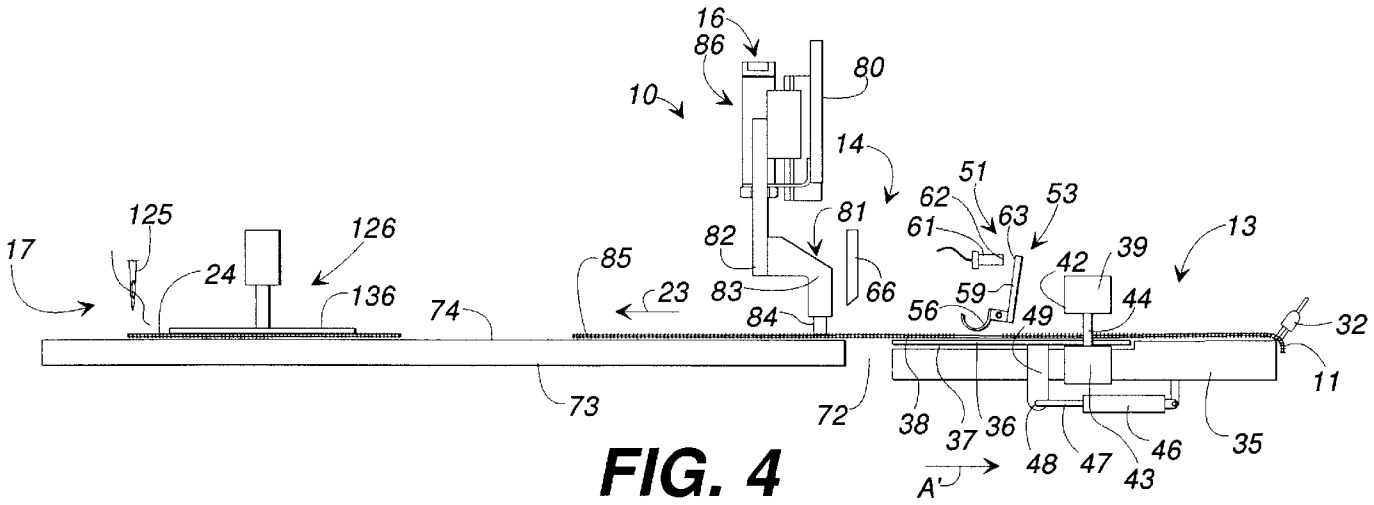
FIG. 4 is a side elevational view of the material feeding, aligning, cutting and edge finishing apparatus, similar to FIG. 3, but schematically illustrating the engagement and drawing out of the sheet material by the draw out assembly.
Figure 5:
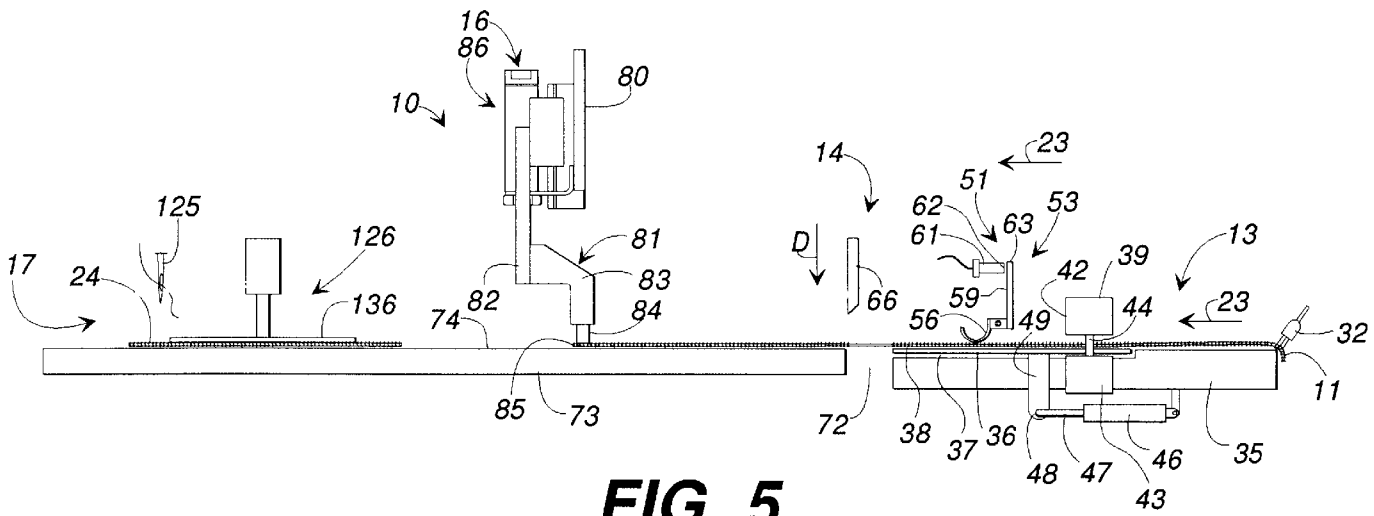
FIG. 5 is a side elevational view of the material feeding, aligning, cutting and edge finishing apparatus, similar to FIG. 4, but schematically illustrating the cutting of the sheet material by the cutting blade.

As illustrated in FIGS. 2 and 5, an indexing cylinder 46 is mounted below the lower surface 37 of the movable table 36 and the stationary shelf 35 of the advancing mechanism 13. The indexing cylinder is mounted to the underside surface of the stationary shelf 35 and extends longitudinally therealong parallel to the direction of movement of the movable table 36 along the processing path 23. The indexing cylinder includes a piston rod 47 that is attached at its free end 48 to the lower surface 37 of the movable table 36 by a clevis 49 or similar attaching bracket or member. As the piston rod is extended and retracted by the indexing cylinder 46, the movable table is moved forwardly in the direction of arrows A, as shown in FIGS. 2 and 3, and retracted rearwardly in the direction of arrows A' (FIG. 4) to move the movable table between its indexed, advanced position and its retracted, initial position.

Figure 7:
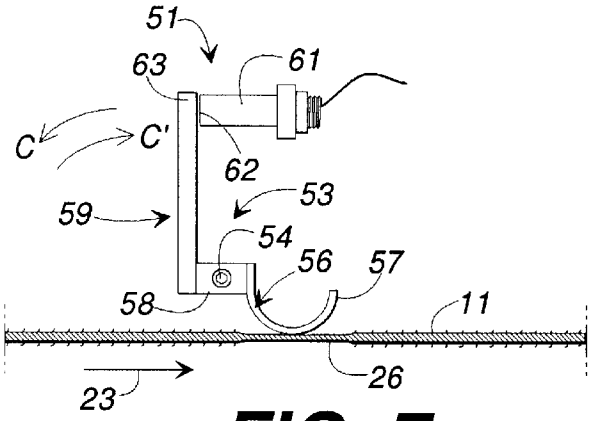
FIGS. 7 is a side elevational view of one of the sensors illustrating the position of the sensor upon engagement with a napless band of the sheet material.
Figure 8:
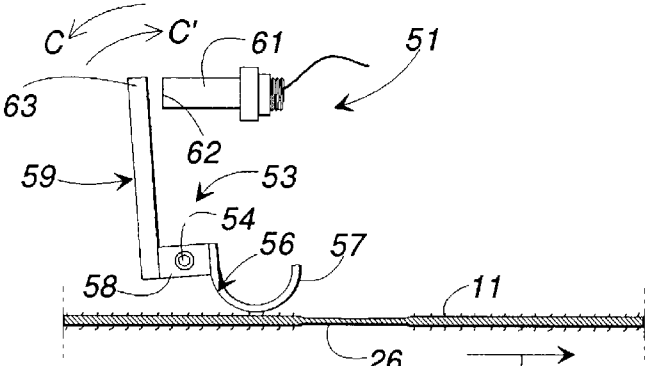
FIG. 8 is a side elevational view of one of the sensors, similar to FIG. 7, but showing the sensor engaging the tufted portion of the sheet material.
Figure 6:
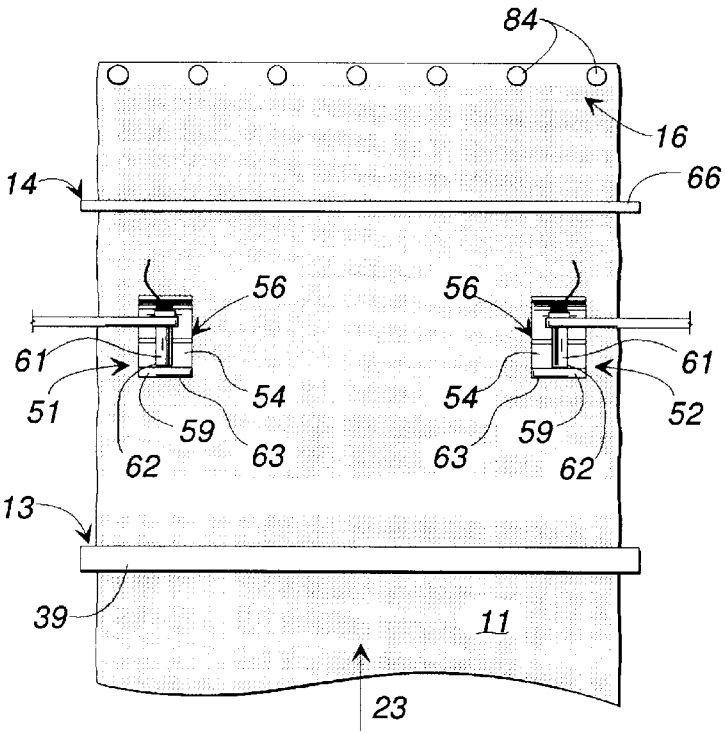
FIG. 6 is a plan view of the leading end of the supply of material, showing the positions of the feet of the draw out bar, the cutting blade, band sensors and clamp bar along the sheet material.

As shown in FIG. 6, a pair of band sensors 51 and 52 are mounted between the cutting station 14 and clamp bar 39, positioned above and in engagement with the sheet material being moved thereunder along the processing path 23. As shown in FIG. 7 and 8, the band sensors each generally include a pivoting arm or trip switch 53 mounted on a pivot pin 54 so as to pivot or tilt in the direction of arrows C and C' (FIG. 8) as the sheet material is advanced along its processing path 23. Each pivot arm generally includes a substantially U-shaped shoe or skid 56 having a curved lower portion 57 that engages and rides upon the sheet material as the sheet material passes thereunder. The shoe 56 is mounted to a hub or connector block 58 mounted to pivot pin 54. A vertically extending rod 59 is mounted to the opposite side of the hub from the shoe 56 and extends upwardly substantially parallel to the shoe 56. As illustrated in FIGS. 7 and 8, a detector 61 such as a photocell or proximity sensor is mounted above the pivoting arm 53, with the front or detecting end 62 of the detector 61 positioned immediately adjacent the upper end 62 of the vertically extending rod 59.

As the sheet material is passed under the shoe 56 of each sensor, as shown in FIG. 8, the tufted portion of the sheet material tends to brush against and urge the shoe in the direction of the movement of the sheet material along its processing path 23, causing the pivoting arm to be pivoted or tilted rearwardly in the direction of arrow C. This causes the upper end 63 of the rod 59 to be moved away from the detector 61. As a napless band 26 passes under the shoe 56, as shown in FIG. 7, the lack of tufting of the napless band causes the pivot arm to pivot forwardly in the direction of arrows C' (FIG. 8) so as to move the upper end of the rod toward the detector 61. The detector detects the presence of the upper end of the rod in close proximity thereto and sends a signal to indicate that a napless band has been detected by the sensor. The timing of the detection of the napless bands by each of the band sensors is used for detecting the approach angle of the napless bands for controlling the advancing, stretching and aligning of the sheet material by the draw out assembly 16 (FIG. 1) to ensure accurate cutting of the sheet material along the napless bands thereof at the cutting station 14.

As illustrated in FIG. 1, the cutting station 14 positioned downstream from the movable table 36 of the advancing mechanism 13 generally comprising a guillotine cutting blade 66 that is positioned over the sheet material 11 along the processing path 23 thereof. The cutting blade 66 generally is an elongated, substantially rectangularly shaped blade that extends laterally across the width of the apparatus 10. The cutting blade is mounted within a holder 67 that extends laterally above and across the apparatus and which is connected to a movable support assembly 68 therefor. The support assembly 68 generally comprises a pair of rods or pitmen 69 mounted to the ends of the cutting blade holder 67. The rods are connected at their lower ends to a drive shaft 71. The drive shaft is rotated to cause the vertical movement of the rods in the direction of arrows D and D'. As a result, the cutting blade is moved through a cutting path engaging and cutting through the sheet material along the napless bands 26 thereof to separate the work segments 24 therefrom.

As illustrated in FIGS. 1–5, a gap 72 is formed between the movable table 36 of the advancing mechanism 13 and a finishing table 73 positioned downstream therefrom and along which the draw out assembly, edge hemming station and discharge assembly are mounted. The guillotine cutting blade 66 of the cutting station is aligned with this gap 72. Thus, as the cutting blade is lowered in the direction of arrow D (FIGS. 1 and 5), the cutting blade is received within the gap, passing between the finishing table 73 and the movable table 36 as it cuts through the sheet material 11 to separate work segments from the sheet material. As illustrated in FIG. 1, the finishing table 73 generally is a substantially rectangularly shaped work table having a smooth, flat upper surface 74. The work segments 24 are received and moved over the upper surface of the finishing table, sliding therealong as the work segment is finished in the edge hemming station and thereafter discharged.

As illustrated in FIGS. 2–5, the draw out assembly 16 is mounted over the upper surface 74 of the finishing table 73 and is movable therealong in a reciprocating motion drawing the sheet material therewith. The draw out assembly 16 generally includes a vertically extending support plate 80 and a substantially Z-shaped draw out bar 81 movably mounted to the support plate. The support plate generally is formed from aluminum or similar metal material, and is oriented vertically. The draw out bar includes a vertically extending slide plate 82 and an L-shaped holder 83 mounted to a rear side surface of the slide plate 82 and extending downwardly therefrom. A series of clamp feet 84 are received within the lower end of the holder, typically mounted in a spring biased mounting thereto. The feet generally are formed from rubber or a resilient, soft non-skid material such as neoprene or the like. The feet engage and press against the sheet material 11 adjacent its a leading edge 85 (FIGS. 3–5) when the sheet material is received thereunder to hold the sheet material against the upper surface of the finishing table as the draw out assembly draws the material therealong.

Figure 9:
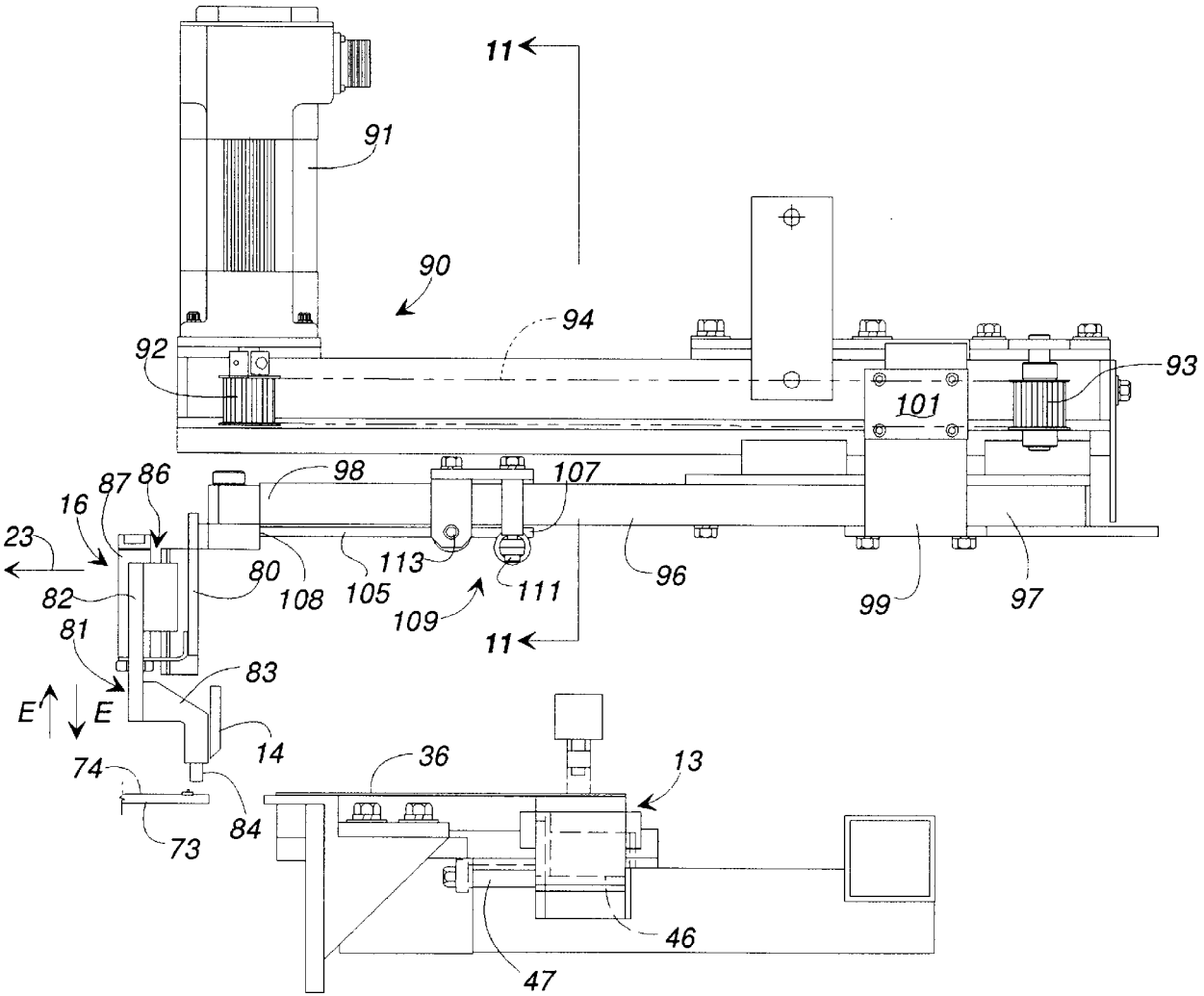
FIG. 9 is a side elevational view of the drive mechanism and pivot arm for moving the draw out assembly.

A cylinder assembly 86 is mounted to a front of the support plate 80 and includes a pair of cylinders 87 mounted at spaced locations between the center and each side edge of the support plate. The cylinders are connected to the slide plate 82 and move the slide plate 82 vertically in the direction of arrows E and E' to move the clamp bar 81 and clamp feet 84 between a lowered position in engagement with the sheet material as shown in FIGS. 3, 4 and 5, and a raised position out of engagement with the sheet material as illustrated in FIGS. 1, 2 and 9. A drive mechanism 90 (FIG. 9) is attached to the support plate 80 along its rear side surface for supporting and moving the draw out assembly along the processing path 23 as indicated in FIGS. 3–5.

As illustrated in FIG. 9, the drive mechanism 90 includes a drive motor 91 mounted above the processing path 23, a drive sprocket 92 mounted beneath the drive motor 91 in a driving relationship therewith, an idler sprocket 93 positioned upstream and spaced from the drive sprocket 92, and a drive belt 94 (shown in phantom lines) that is circumscribed about the drive sprocket 92 and idler sprocket 93. The drive motor 91 typically is a reversible variable speed motor which rotates the drive sprocket 92 in clockwise and counterclockwise directions to move the drive belt forwardly and rearwardly between the idler and drive sprockets.

A support arm 96 is mounted beneath and extends longitudinally substantially parallel to the drive belt and the processing path 23. The support arm typically is rectangularly shaped and is formed from metal such as aluminum and includes a first or rearward end 97 and a second or forward end 98. A carriage bracket 99 is mounted to the support arm 96 adjacent its first or rearward end 97 and is attached to the drive belt 94, with the drive belt extending between a pair of upstanding bracket plates 101 and 102 (FIG. 10) of the carriage bracket 99. Thus, as the drive belt is moved forwardly or rearwardly by the rotation of the drive sprocket 92 by drive motor 91, the support arm is moved forwardly or rearwardly along the processing path 23 to move the draw out assembly 16 along the processing path.

Figure 11:
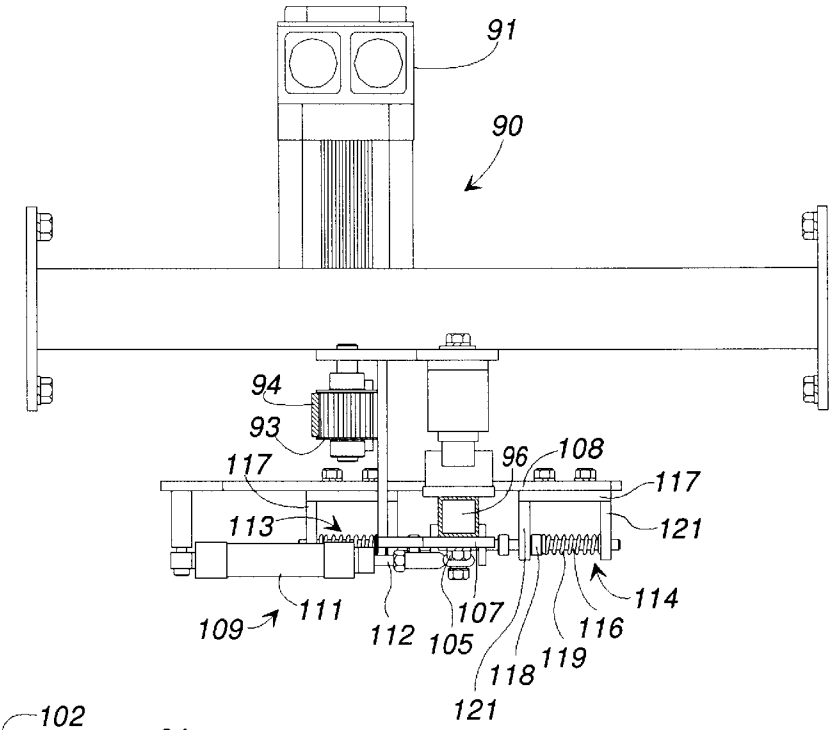
FIG. 11 is a cross-sectional view of the pivot arm and adjustment cylinder taken along lines 11—11 of FIG. 9.
Figure 10:
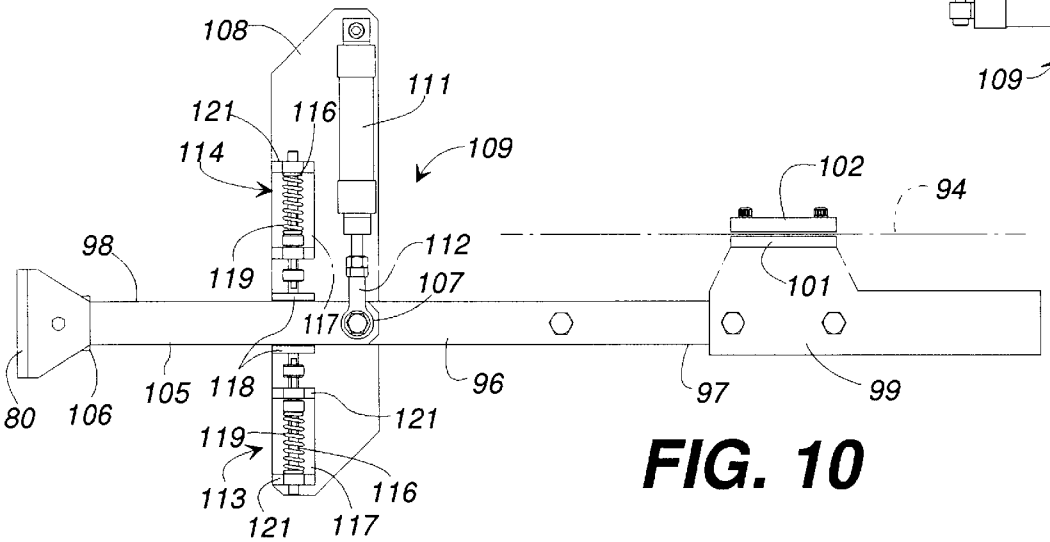
FIG. 10 is a bottom view of the pivot arm for the draw out assembly.

As illustrated in FIGS. 9 and 10, a pivot arm 105 is pivotally attached to the support arm adjacent the second or forward end 98 of the support arm. The pivot arm is substantially rectangularly shaped and has a forward end 106 that is attached to the support plate 80 of the draw out assembly 16, and a rearward end 107 that pivotally attaches to the support arm 96 as shown in FIGS. 10 and 11. A base plate 108 is mounted over the support arm 96 and supports an adjustment assembly 99 for the draw out assembly.

The adjustment assembly 99 includes an adjustment cylinder 111 mounted to the base plate 108 and including a piston rod 112 that is attached to the rearward end 107 of the pivot arm 105. The adjustment cylinder is actuated in response to the detection of a napless band 26 (FIG. 6) by the band sensors 51 and 52 at different intervals or times, which is indicative of the napless band approaching the cutting station at an angle with respect to the cutting blade. In response to such detection by the band sensors, the adjustment cylinder is actuated to extend or retract its piston rod to push or pull the pivot arm laterally. This causes the support plate 80 (FIG. 9) and draw out bar 81 of the draw out assembly 16 also to be pivoted so as to stretch the sheet material along the side that is lagging behind to realign the napless band with a line extending substantially perpendicular to the processing path as the draw out assembly is moved forwardly by the drive mechanism to draw out the sheet material for pulling the segments therein. As a result, the napless bands are automatically accurately aligned with the cutting blade of the cutting station to ensure that the cutting blade will cut approximately through the center of the napless bands to form work segments.

As further illustrated in FIGS. 10 and 11, shock absorbers 113 and 114 are mounted to the base plate 108 on opposite sides of the pivot arm 105. The shock absorbers are adapted to be engaged by the pivot arm as the pivot arm is pivoted laterally by the adjustment cylinder 111. Each of the shock absorbers generally includes a laterally extending push rod 116 mounted within a substantially U-shaped holder 117 and having a push plate 118 mounted at the front ends thereof. Compression springs are mounted about the push rods between downwardly extending flanges 121 of the holders 117. As the pivot arm is pivoted laterally by the extension or retraction of the piston rod of the adjustment cylinder, the pivot arm pushes against the push rod 116 of one of the shock absorbers 113 or 114. Once the adjustment cylinder is deenergized, the shock absorber biases the pivot arm back to its initial, unpivoted position so that the draw out assembly returns to its straightened, unpivoted position (FIG. 1).

The edge hemming station 17 (FIG. 1) is described in more detail in my prior U.S. Pat. No. 5,018,462, which is incorporated herein by reference. The edge hemming station 17 includes generally, a sewing head 125, a transport plate assembly 126, and a transport plate control system 127.

The transport plate control system 127 includes a longitudinal travel beam 128 and a lateral travel beam 129, which is slidable along the longitudinal travel beam parallel to the processing path in the direction of arrows 131 and 131'. A motor 132 controls the longitudinal movement of the lateral travel beam 129 along the longitudinal travel beam 128. The lateral travel beam 129 includes a track (not shown) on its underside, along which slides the transport plate assembly 126. A motor 133 controls the movement of the transport plate assembly in the direction indicated by arrows 134 and 134' along the lateral travel beam. Thus, an X-Y coordinate system is established about the work surface 74 of the work table 73 through which a cut segment 24 of sheet material 11 can be maneuvered from the cutting station 14 to the edge-hemming station 17 and then to the discharge station 18.

The transport plate assembly 126 includes a transport plate 136 that moves downwardly into flat engagement with a work segment 24. The facing surface of transport plate 136 includes a soft material (not shown) that engages the upper surface of segment 24 so that a relatively firm gripping force is applied by the transport plate to the cloth material. The transport plate carries the segment through a finishing and hemming operation.

The discharge station 18 is positioned adjacent the sewing head 125 of the edge hemming station. The discharge station includes a pair of conveyor belts 137 and 138, extending about rollers 139. The conveyor belts are pivotable up and down about a pivot rod 141. In operation, the conveyor belts pivot downwardly into horizontal alignment with the work table to engage the work segment 24 after it has been hemmed. A motor (not shown) drives the conveyor belts, causing the conveyor belts to propel the work segment forwardly off of the finishing table where the segment falls to a secondary conveyor (not shown) to form a stack of segments. The secondary conveyor is intermittently operated to move an accumulated stack of segments out of the way of the next oncoming towel segments.

OPERATION

As shown in FIGS. 1–5, the sheet material 11 is fed from its supply onto the shelf 35 and movable table 36 of the advancing mechanism 13. The sheet material initially is engaged by the clamp bar 39 of the advancing mechanism, which engages and holds the sheet material against the upper surface 38 of the movable table. The movable table 36 is indexed forward in the direction of arrows A (FIGS. 2 and 3) by its indexing cylinder 46, to move the sheet material forwardly along its processing path 23. The sheet material is moved across the gap 72 between the movable table and finishing table 73 with the foremost edge of the sheet material passing through the cutting station 14 to a position beneath the feet 84 of the draw out assembly 16. Thereafter, the draw out bar 81 of the draw out assembly is lowered to move the feet into engagement with the sheet material. At the same time, the clamp bar 39 of the advancing mechanism is lifted to its raised position out of engagement with the sheet material.

As illustrated in FIGS. 3 and 4, the draw out assembly is moved forwardly by the drive mechanism so that the sheet material is pulled forwardly along its processing path, moving over the upper surface of the finishing table 73 to draw out a sufficient amount of the sheet material to form a work segment 24. As the sheet material is drawn forwardly by the draw out assembly 16, the sheet material is pulled beneath the band sensors 51 and 52 (FIG. 6), which ride along the surface of the sheet material.

As a napless band 26 of the sheet material 11 passes under the band sensors, the pivot arms 53 of the band sensors are pivoted in the direction of arrows C' (FIG. 8) to an upright position shown in FIG. 7 in which the upper end 63 of the rod 59 of the pivot arm 53 of each band sensor is moved into close proximity with the detector 61. As each of the band sensors 51 and 52 (FIG. 6) engages and detects the presence of the napless band thereunder, the sensors send a signal to the apparatus control system indicating the presence of the napless band. As the napless band is detected at staggered intervals by the band sensors, the system knows that the napless band is approaching the cutting station at an angled, misaligned orientation with respect to the cutting blade 66.

In response to the detection of the napless band approaching the cutting station at an angle, an adjustment cylinder 111 (FIG. 10) is actuated and extends or retracts its piston rod 112, depending upon which band sensor 51 or 52 (FIG. 6) engages the napless band first. For example, if band sensor 51 along the left side of the sheet material engages the napless band first, the system knows that the left side of the sheet material is leading, and the piston rod of the adjustment cylinder 111 (FIG. 10) is extended to cause the rearward end 107 of pivot arm 105 to be moved towards the right side of the processing path. In turn, this causes the support plate 80 and draw out bar 81 of the draw out assembly 16 to be pivoted so that their right sides are urged forwardly. If the band sensor 52 (FIG. 6) along the right side of the sheet material detects the napless band first, the adjustment cylinder is caused to retract its piston rod so as to pivot the rearward end of the pivot arm 105 (FIG. 10)

toward the left side of the processing path, and thus to pivot the support plate and draw out bar of the draw out assembly so that the left side of the draw out assembly is urged forwardly. As a result, the side of the sheet material that is lagging behind is stretched forwardly so as to be pulled slightly ahead of the left side of the sheet material in order to realign the napless band along a line extending perpendicular to the processing path so that the napless band becomes aligned parallel to the cutting blade of the cutting station. Thus, the orientation of the napless bands of the sheet material is detected and the napless bands are automatically and accurately aligned, if necessary, with the cutting blade of the cutting station so that the cutting blade will cut approximately through the center thereof. This ensures that the segments of sheet material will be cut in equal lengths with substantially straight cut edges.

Once the napless bands have been detected and, if necessary, aligned with the cutting blade 66 (FIGS. 4 and 5), the drawing out of the sheet material by the draw out assembly is stopped with the napless band being aligned under the cutting blade 66. At the same time, the movable table has been moved to its initial, retracted position whereupon the clamp bar 39 of the advancing mechanism 13 is lowered into its engaged, clamping position, clamping the sheet material against the upper surface of the movable table. The sheet material thus is held in a stretched, taut position for cutting. The cutting blade is moved downwardly in the direction of arrow E (FIG. 5) to cut through the sheet material at a napless band to form a work segment 24.

After the work segment 24 has been cut from the sheet material, the draw out bar and feet of the draw out assembly are raised from engagement with the work segment, and the draw out assembly is moved rearwardly back to its initial nonengaging position adjacent the cutting station as shown in FIG. 2. Simultaneously with the return of the draw out assembly to its initial position, the transport plate assembly 126 moves over and engages the work segment. The transport assembly moves the work segment forwardly along its processing path 23 into engagement with a sewing head 125 of the edge hemming station 17 wherein the edges of the work segment are cut and sewn by the sewing head to form a finished work product such as a washcloth or towel. After the last side edge of the work segment has been finished by the sewing head of the edge hemming station, the transport plate 136 of the transport plate assembly 126 is raised out of engagement with the work segment and is moved toward the draw out assembly for engagement with the next segment cut from the sheet material by the apparatus.

While the transport plate assembly is moving into a position to engage the next work segment, conveyor belts 137 and 138 (FIG. 1) are pivoted into engagement with the finished work segment. The conveyor belts are rotated to pull the work segment off the upper surface 74 of the finishing table 73 and on to a secondary conveyor (not shown) which accumulates a stack of finished segments for later transport to packaging, etc.

The present invention thus provides a method and apparatus for the cutting and finishing of flat material work products such as washcloths, towels, etc. formed from a tufted material or other types of flat materials, in which the products can be cut from a supply of sheet material with the advancing and cutting of the sheet material being controlled to ensure that the cut edges of the segments of sheet material are substantially straight and that the cut segments are of substantially equal size, while still enabling an efficient and high speed production rate of such work products.

It will be apparent to those skilled in the art that although the present invention has been disclosed with reference to a preferred embodiment thereof, various modifications, changes and additions can be made to the invention without departure from the spirit and scope of the invention as set forth in the following claims.

I claim:

1. A system for cutting elongated sheet material parallel to laterally extending napless bands of the sheet material as the sheet material is advanced along a processing path from a supply to a cutting station, the system comprising:

cutting means for cutting across the sheet material, advancing means for pushing a cut end of the sheet material along the processing path past said cutting means, draw out means for pulling the cut end of the sheet material along the processing path to move the sheet material into a cutting position, sensor means positioned upstream along the processing path from the cutting means for determining the approach angle of one of the laterally extending napless bands in the sheet material, and means responsive to the sensor means for pivoting said draw out means and urging said one of the napless bands of the material toward a position parallel to the cutting means.

2. The system of claim 1, wherein the draw out means comprises a movable draw out bar adapted to press down on the sheet material and pull the sheet material along the processing path past said cutting means.

3. The system of claim 1, and wherein said advancing means comprises a movable table positioned adjacent said cutting means, said movable table having a substantially continuous surface on which the sheet material can be releasably secured and being movable from a first, retracted position to an indexed, extended position below said cutting means to move the sheet material past said cutting means.

4. The system of claim 1 and wherein said sensor means comprises a pair of band sensors positioned above and in engagement with the sheet material and each including a pivotable arm adapted to pivot in response to the movement of the laterally extending napless bands of the sheet material passing thereunder to signal the approach angle of each napless band of the sheet material moving toward said cutting means.

5. The system of claim 2 and wherein said draw out bar is pivotally mounted at one end, and wherein said means responsive to said sensor means comprises a cylinder assembly mounted along said draw out bar and linked to said sensor means, and including a movable piston rod that is extended and retracted in response to detection of the approach of a napless band which is not parallel to said cutting means, for pivoting said draw out bar with respect to the processing path to realign the sheet material for cutting.

6. The system of claim 1 and further comprising a transport plate assembly for moving a cut segment of the sheet material through an edge hemming station for finishing said segments.

7. The system of claim 6 and further comprising a discharge assembly adjacent said edge finishing station for removing finished segments from said edge hemming station.

8. An apparatus for cutting a segment of sheet material from a supply of sheet material and finishing the segment to produce a segment of sheet material having an edge-finished border, the supply of sheet material having laterally extending bands spaced along its length, and the apparatus comprising:

a cutting station for cutting the supply of sheet material into segments, said cutting station including cutting means for cutting across the sheet material, advancing means for urging the cut edge of the sheet material beyond said cutting station, sheet material draw out means for engaging and pulling the cut end of the sheet material along the processing path past said cutting means, sensor means positioned upstream in the processing path from said cutting means for determining the approach angle of laterally extending bands in the sheet material, means responsive to said sensor means for repositioning the laterally extending bands of the sheet material parallel to the cutting path, an edge finishing apparatus for edge finishing the cut segment of sheet material, and a transport plate assembly for moving a previously cut segment of sheet material from said cutting station to said edge finishing apparatus, whereby said advancing means advances the sheet material to said cutting station where said cutting means cuts along the laterally extending bands of the sheet material to cut a segment of sheet material from the supply of sheet material and said transport plate assembly moves the segment to said edge finishing apparatus wherein the edges of the segment of sheet material are edge-finished.

9. The apparatus of claim 8, and further comprising means for removing the edge finished segment of sheet material from said edge finishing apparatus.

10. The apparatus of claim 8 and wherein said sheet material draw out means comprises a movable draw out bar adapted to engage the sheet material, and drive means for moving said draw out bar along the processing path for drawing out the sheet material for segmenting.

11. The apparatus of claim 10 and wherein said means responsive to said sensor means comprises a cylinder assembly mounted along said draw out bar and linked to said sensor means, and including a movable piston rod that is extended and retracted in response to the approach angle of a napless band with respect to said cutting means, for pivoting said draw out bar with respect to the processing path to realign the sheet material for cutting.

12. The apparatus of claim 8 and wherein said advancing means comprises a movable table positioned adjacent said cutting means, said movable table having a substantially continuous surface on which the sheet material can be releasably secured and being movable from a first, retracted position to an indexed, extended position below said cutting means to move the sheet material past said cutting means.

13. The apparatus of claim 8 and wherein said sensor means comprises a pair of band sensors positioned above and in engagement with the sheet material and each including a pivotable arm adapted to pivot independently of one another in response to the movement of a laterally extending napless band of the sheet material passing thereunder to signal the approach of the sheet material toward said cutting means at a nonparallel orientation.

14. A method of cutting elongated sheet material parallel to laterally extending bands of the sheet material, as the sheet material is advanced along its length from a supply in a processing path to a cutting station, and edge finishing the perimeter of a cut segment of the sheet material, the method comprising the steps of:

moving the sheet material along the processing path past the cutting station, determining the approach angle of a laterally extending band in the sheet material, in response to the approach of the laterally extending band toward the cutting station in a nonparallel orientation thereto, pulling a leading edge of the sheet material such that a lagging side of the material that is lagging behind a leading side of the material is longitudinally advanced along the processing path at a rate of speed greater than that of the leading side until the laterally extending band is realigned to be parallel to the cutting station, cutting along the laterally extending band across the sheet material to form a cut segment, and edge finishing the perimeter of the cut segment of sheet material.

15. The method of claim 14 and wherein the step of moving the sheet material comprises engaging the sheet material against a movable table and advancing the movable table along the processing path to move the leading edge of the sheet material past the cutting station.

16. The method of claim 15 and further comprising the steps of engaging the sheet material adjacent its leading edge with a draw out assembly and drawing out a length of sheet material sufficient to form the cut segment of sheet material.

17. The method of claim 18 and wherein the step of determining the approach angle of a laterally extending band comprises engaging sensors mounted along opposite sides of the processing path as the sheet material moves thereunder, independently actuating the sensors as the laterally extending band moves thereunder to detect the approach of the laterally extending band which is not parallel to the cutting station in response to the actuation of the sensors at differing intervals.

18. The method of claim 16 and wherein the step of repositioning the laterally extending band comprises pivoting the draw out assembly in engagement with the sheet material with respect to the processing path in response to the determination of the approach angle of the laterally extending band of the sheet material approaching the cutting station to advance the lagging side of the sheet material forwardly to realign the laterally extending band with respect to the cutting station.

19. A method of finishing work segments of sheet material as the sheet material is moved along a processing path, comprising the steps of:

advancing the sheet material along its processing path from a supply roll toward a cutting station;

engaging a portion of the sheet material with a clamp means;

moving a leading edge of the sheet material through the cutting station with the clamp means;

engaging the sheet material with a draw out assembly and drawing out an amount of the sheet material to form a work segment; and cutting the sheet material along a laterally extending band of the material to form a cut work segment.

20. The method of claim 19 and further including the step of determining the approach angle of the laterally extending bands of the sheet material approaching the cutting station.

21. The method of claim 20 and wherein the step of determining the approach angle of a laterally extending band comprises engaging sensors mounted along opposite sides of the processing path as the sheet material moves thereunder, independently actuating the sensors as the laterally extending band moves thereunder to detect the approach of the laterally extending band which is not parallel to the cutting station in response to the actuation of the sensors at differing intervals.

22. The method of claim 21 and wherein the step of repositioning the laterally extending band comprises pivoting a draw out bar in engagement with the sheet material with respect to the processing path in response to the determination of the approach angle of the laterally extending band of the sheet material approaching the cutting station, and moving one side of the sheet material forwardly to realign the laterally extending band with respect to the cutting station.

23. The method of claim 21 and further including the step of finishing the edges of the cut work segments at an edge finishing station.

* * * * *